US006278856B1

(12) United States Patent
Yamamoto

(10) Patent No.: US 6,278,856 B1
(45) Date of Patent: Aug. 21, 2001

(54) DEVELOPING APPARATUS FEATURING A BRUSH ROLLER HAVING BOTH LOW AND HIGH RESISTANCE FILAMENTS

(75) Inventor: Takeshi Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/386,152

(22) Filed: Aug. 31, 1999

(30) Foreign Application Priority Data

Sep. 3, 1998 (JP) ..... 10-265692
Oct. 12, 1998 (JP) ..... 10-306383

(51) Int. Cl.[7] ..... G03G 15/08

(52) U.S. Cl. ..... 399/281

(58) Field of Search ..... 399/272, 281

(56) References Cited

U.S. PATENT DOCUMENTS 4,481,903 * 11/1984 Haberhauer et al. ..... 399/281
5,172,189 * 12/1992 Takashima et al. ..... 399/281

FOREIGN PATENT DOCUMENTS 58-116559 7/1983 (JP) .

* cited by examiner

*Primary Examiner*—William J. Royer
(74) *Attorney, Agent, or Firm*—Fitzpatrick, Cella, Harper & Scinto

(57) ABSTRACT

A developing apparatus has a developer bearing member for bearing developer to carry it to a developing portion, and a developer-supplying device for supplying developer to the developer bearing member. The developer-supplying device is not in contact with the developer bearing member and includes a brush roller, which is formed by blending at least two types of filaments.

12 Claims, 4 Drawing Sheets

DEVELOPING APPARATUS FEATURING A BRUSH ROLLER HAVING BOTH LOW AND HIGH RESISTANCE FILAMENTS

BACKGROUND OF THE INVENTION

1. Field of the Invention

The present invention relates to a developing apparatus for use in an image forming apparatus such as an electrophotographic device or an electrostatic recording device.

2. Related Background Art

In an image forming apparatus in which an electrophotographic method is used, an electrostatic latent image is formed on an image bearing member and is developed to be visualized as a toner image, which is transferred onto a transfer material so as to obtain an image.

As a developing method in the above, there are generally a monocomponent developing method with monocomponent developer composed of magnetic toner only and a two-component developing method with two-component developer composed of magnetic particles (magnetic carrier) and nonmagnetic toner; the monocomponent developing method has merits such as a simple constitution of a developing apparatus and easy maintenance in comparison with the two-component method, and therefore various types of developing apparatuses for the monocomponent developing method have been suggested and put into practical use.

There is suggested a developing method with nonmagnetic monocomponent developer composed of nonmagnetic toner only as shown in Japanese Patent Application Laid-open No. 58-116559, and low-cost and small-sized developing apparatuses which are capable of generating high-quality color images have been put into practical use, so as to cope with an increase of color images in recent years.

An example of a non-magnetic monocomponent developing apparatus is shown in FIG. 6. As shown in FIG. 6, the developing apparatus has a developer container 3 containing non-magnetic toner of the non-magnetic monocomponent developer type, a developing sleeve 1 rotated as a developer bearing member disposed therein, and a toner supplying roller 14 as a developer supplying member and a regulating blade 13 as a developer regulating member abutting against the developing sleeve 1.

The toner supplying roller 14 is formed by a metal core 14*a* such as SUS coated by an elastic member 14*b* made of urethane foam on its outer peripheral surface and it rotates while sliding frictionally with the developing sleeve 1 to supply non-magnetic toner contained in the developer container 3 to a surface of the developing sleeve 1 and to scrape off nonmagnetic toner returned to the inside of the developer container 3 with the rotation of the developing sleeve 1 without contributing to the development in the developing section opposite to a photosensitive drum from the surface of the developing sleeve 1.

For the regulating blade 13, an elastic member 13*b* made of urethane rubber or the like is bonded in the opposite side of the developing sleeve 1 of a supporting member 13*a* made of phosphor bronze, and the elastic member 13*b* is put into contact with a surface of the developing sleeve 1 to regulate toner born on the developing sleeve 1 so as to form a thin toner layer and to triboelectricity charge the toner.

According to the constitution set forth in the above, the developing apparatus is capable of favorably forming a thin layer of charged non-magnetic toner on the developing sleeve 1 to supply the toner for development of an electrostatic latent image formed on a surface of the photosensitive drum, by which the latent image can be developed favorably.

In the above nonmagnetic monocomponent developing apparatus, however, the charge supply to the toner is mainly performed at a regulation of a thickness of the toner layer with the regulating blade 13, and the toner is charged by contact friction generated when the toner passes the regulating blade 13. In addition, the supplying roller 14 is made to abut against the developing sleeve 1 so as to rub the toner to supply it to the developing sleeve 1 while collecting toner on the developing sleeve 1.

Accordingly, in the non-magnetic monocomponent developing apparatus, an enormous mechanical load is applied on the toner in the developer container 3 and therefore damage to the toner is extremely large in comparison with other developing methods.

Furthermore, depending upon a disposed position or a rotary direction of the toner supplying roller 14, toner which has not contributed to development cannot be collected completely and sometimes toner remains on the developing sleeve 1. Although the residual toner on the developing sleeve 1 is carried to a developing zone passing the regulating blade 13 again, repetition of this carry-back (re-carry) causes outer additive or the like which controls a charged amount or flowability of toner to be buried into the inside of the toner due to a mechanical friction applied to the toner every time or an accumulated heat, by which the toner is deteriorated and desired electrification properties or flowability cannot be obtained.

This deteriorated toner causes a lot of problems in an image formation process. For example, if deteriorated toner is used for development, a development failure may occur since appropriate development properties cannot be obtained or a transfer hollow of an image may occur at a transfer operation. Furthermore, a new toner supply to the developing sleeve 1 is obstructed to lower a coating amount of toner on the developing sleeve 1, by which a poor density may occur. In addition, if deteriorated toner fuses in a nip portion between the regulating blade 13 and the developing sleeve 1 or on the surface of the developing sleeve 1, a toner coating failure such as a line on the developing sleeve 1 may occur and a charge supply to new toner supplied to the developing sleeve 1 may be obstructed. Accordingly, uncharged toner is carried to the developing zone, which may cause an image failure such as a fogging or unevenness.

Furthermore, in a nonmagnetic monocomponent developing apparatus, the enormous load is applied not only on toner, but also on the developing apparatus itself. For example, regarding the toner supplying roller 14, if it is formed into a sponge roller as described in the above, a rubbing friction applied to the developing sleeve 1 for a long time leads to wear or a damage of the toner supplying roller 14 itself or clogging of toner, and therefore toner cannot be favorably supplied nor collected.

As described above, the nonmagnetic monocomponent developing apparatus generates favorably developed images in spite of having a simple constitution, while an enormous load is applied to toner and the apparatus, lacking a long-term stability in comparison with a magnetic monocomponent developing apparatus and a two-component developing apparatus. Therefore, this method is mainly used for cartridge-type developing apparatuses which themselves are replaced with new ones when toner is used up and it is not often used for toner-replenishing type developing apparatuses.

SUMMARY OF THE INVENTION

It is an object of the present invention to provide a developing apparatus in which a load on developer can be reduced when the developer is supplied to a developer bearing member.

It is another object of the present invention to provide a nonmagnetic monocomponent developing apparatus in which a load on toner at charge supply or at toner supply to a developing sleeve is significantly reduced to achieve low-stress coating and in which toner coating is successfully performed without reversal or uncharged toner, so that it can be used also as a toner-replenishing type developing apparatus for a long period.

It is still another object of the present invention to provide a developing apparatus comprising a developer bearing member for bearing developer to carry it to a developing portion and a developer supplying means for supplying developer to said developer bearing member, being disposed so as not to be in contact with the developer bearing member, the developer supplying means having a brush roller which is formed by blending at least two types of filaments.

Other objectives and features of the present invention besides those discussed above shall be more apparent upon a reading of the following detailed description when taken with the accompanying drawings.

DETAILED DESCRIPTION OF THE PREFERRED EMBODIMENTS

An embodiment according to the present invention will be described in detail below with reference to the accompanying drawings.

[First Embodiment]

Figure 1:
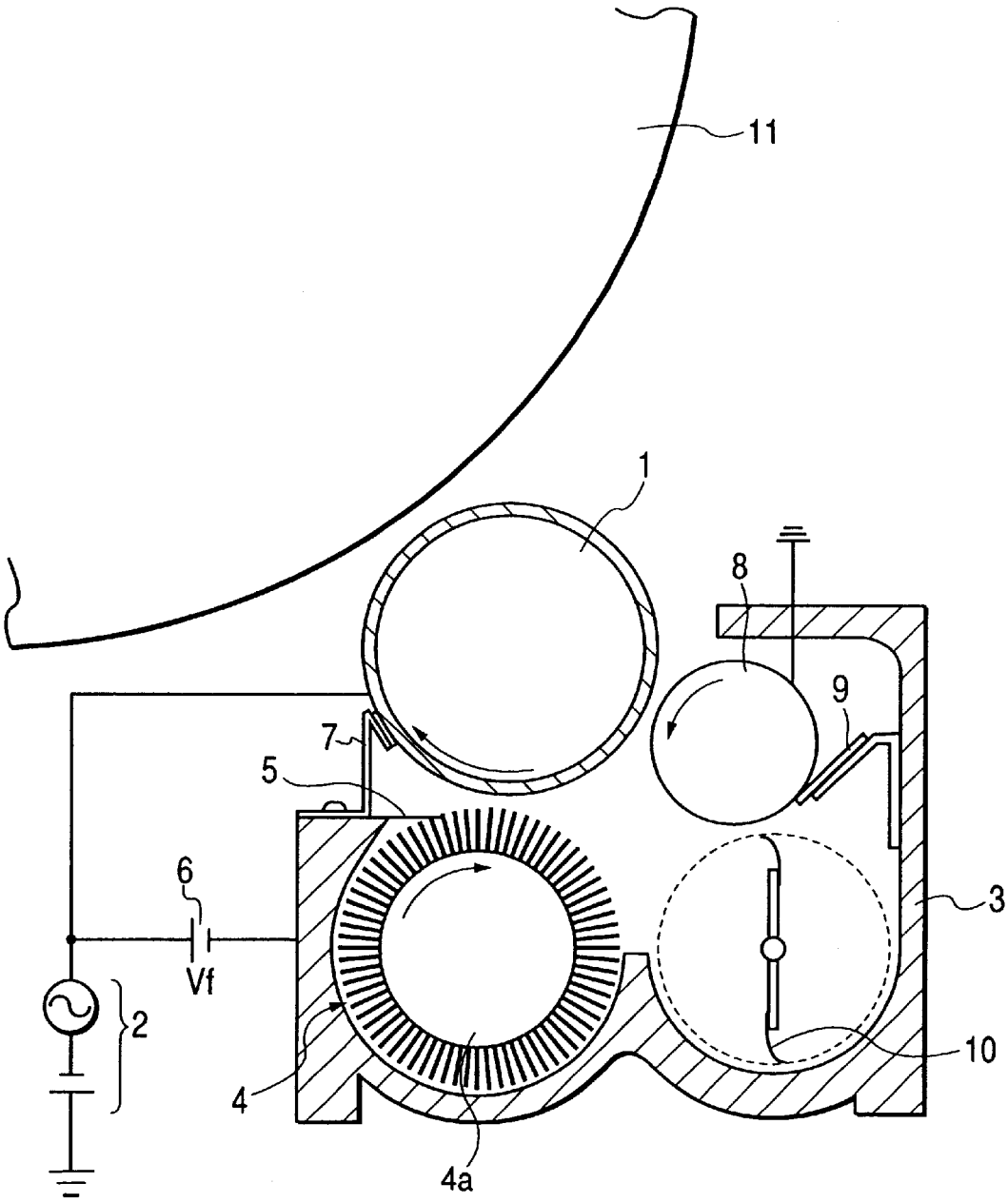
FIG. 1 is a sectional view of an embodiment of a developing apparatus according to the present invention.

Referring to FIG. 1, there is shown a sectional view of an embodiment of a developing apparatus according to the present invention.

As shown in FIG. 1, the developing apparatus of this embodiment has a developer container 3 containing nonmagnetic toner of monocomponent developer and a developing sleeve 1 spaced a predetermined distance away from a photosensitive. drum 11 as a developer bearing member in an opening portion of the developer container 3 opposite to the photosensitive drum 11, the developing sleeve 1 rotating in a direction indicated by an arrow. A developing bias is applied to the developing sleeve 1 from a power supply 2, with the developing bias generated by superposing a DC voltage and an AC voltage.

A toner supplying brush 4, a toner flow path control member 5, and a toner regulating member (an elastic blade) 7 are arranged for the developing sleeve 1, and further a toner collecting roller 8 is arranged in the inner side of the developing sleeve 1 viewed from the opening portion of the developer container 3 and an agitating member 10 is under the toner collecting roller 8. A scraper 9 is arranged so as to abut against the toner collecting roller 8.

The toner-supplying brush 4, which is used for supplying nonmagnetic toner contained in the developer container 3 to the developing sleeve 1, is arranged almost under the developing sleeve 1 being spaced about 100 $\mu$m to 1 mm apart therefrom rotatably in the same direction as the rotary direction of the developing sleeve 1 (in the reverse direction at the nearest portion to the developing sleeve 1). A metal core 4*a* of the toner-supplying brush 4 is connected to a power supply 6 for applying a bias, which applies a desired voltage generated by superposing a DC voltage Vf on the developing bias.

Figure 2A:
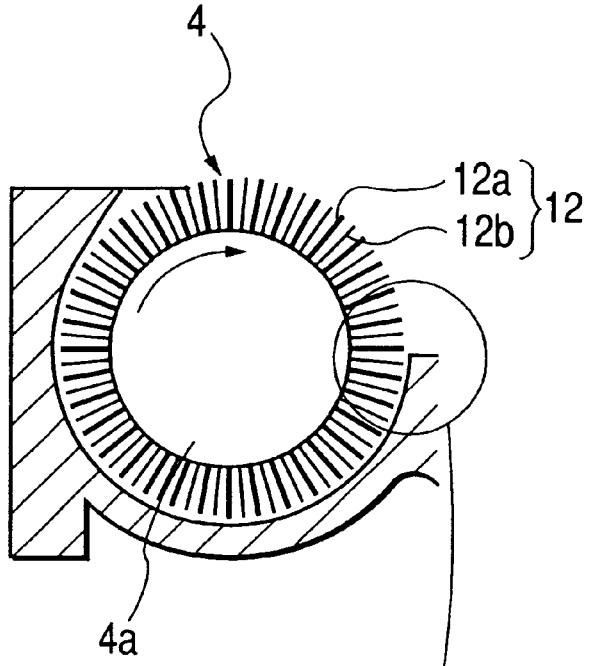
FIGS. 2A and 2B are diagrams showing a toner supplying brush disposed in the developing apparatus in FIG. 1 and its filaments.
Figure 2B:
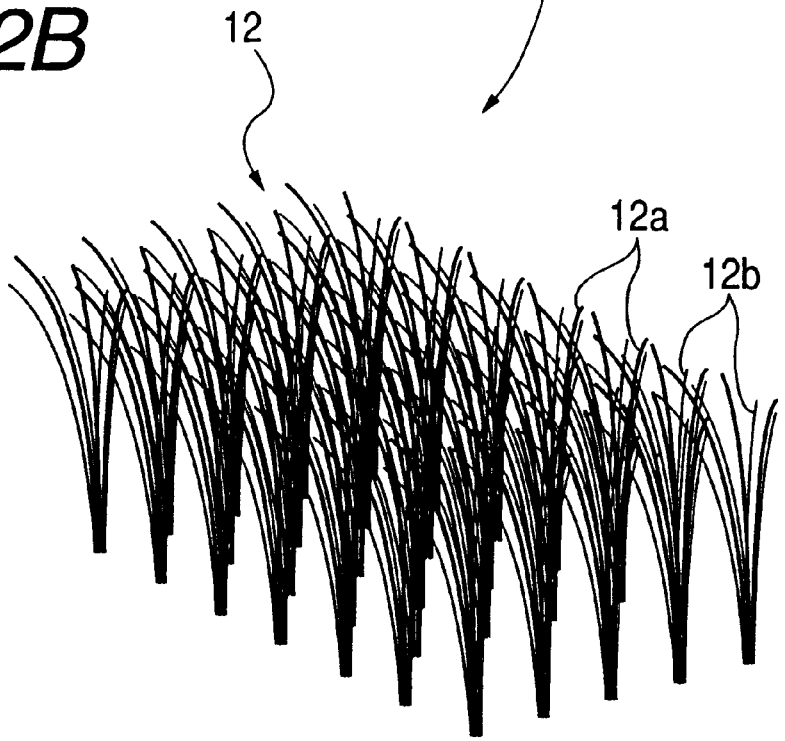

According to this embodiment, as shown in FIGS. 2A and 2B, the toner-supplying brush 4 is a fur brush (brush roller) formed by a metal core 4*a* such as SUS wound around by a brush member 12 made of two mixed types of filaments such as conductive filaments 12*a* having a low resistance of a $10^2$ to $10^8$ Ωcm volume resistance and insulating filaments 12*b* having a high resistance of a $10^8$ to $10^{15}$ Ωcm volume resistance.

In this embodiment, nonmagnetic toner charged to the negative polarity is used, and therefore the insulating filaments 12*b* preferably has a positive charging polarity and nylon filaments (having a $10^8$ to $10^{15}$ Ωcm volume resistance) are used here. The insulating filaments 12*b* are not limited to this, however, and the type of the filaments can be appropriately selected according to characteristics of toner out of various types of filaments having insulation property; rayon filaments or the like can be used in this embodiment.

Figure 3:
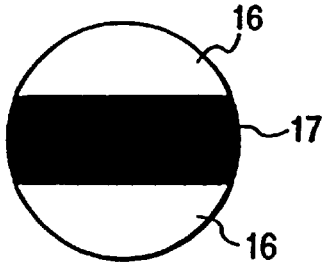
FIG. 3 is a sectional view of a conductive filament which is one type of the brush filaments in FIG. 2.

The primary condition of the conductive filaments 12*a* is to satisfy the above resistance range of $10^2$ to $10^8$ Ωcm. In most conductive filaments, however, carbon or other conductive material is dispersed in the insulating filaments in a stage of a stock solution prior to spinning into the insulating filaments and then the stock solution is spun into the filaments for manufacturing, and in the conductive filaments 12*a,* as shown in FIG. 3, a monofilament of the insulating filaments includes a conductive portion 17 dispersed in an insulating portion 16.

While the conductive material dispersing method depends upon a textile manufacturer, the conductive portion 17 does not necessarily cover the entire surface of the insulating portion 16 of the monofilament, and therefore taking into consideration a contact between an exposed portion of the monofilament surface not covered by the conductive portion 17 and toner, it is preferable to use an insulating filament material having a positive charging polarity to toner. In this embodiment, nylon is used as insulating filament material for the conductive filaments 12.

In this embodiment, both of the conductive filaments 12*a* and the insulating filaments 12*b* need to have an elasticity for clouding toner as described later. Accordingly, fineness (thickness) of both of the filaments is set to about 1 to 10 denier per filament and both of the filaments are mixed so as to have a flocking density of 10,000 to 200,000 pieces/inch$^2$ and to have a pile length of 1 to 10 mm.

The toner flow path control member 5 is used for clouding toner borne by the toner supplying brush 4 and for popping out the toner in a direction of the developing sleeve 1, and it is arranged so as to be in contact with the toner-supplying brush 4 at a portion of the developer container 3 under the developing sleeve 1. In this embodiment, an SUS, phosphor bronze, or other metal thin plate having a thickness of 100 $\mu$m to 1 mm is used as the toner flow path control member 5.

This toner flow path control member 5 is not limited to a straight shape as shown in the diagram, but the shape can be modified depending upon a direction of clouding toner. In addition, taking into consideration a charge supply to toner on a contact surface of the toner-supplying brush 4, a resin layer having a high capability of supplying charges to toner may be arranged on the contact surface of the toner flow path control member 5 with the toner-supplying brush 4. This arrangement stabilizes the charge supply to toner.

The toner regulating member 7, which is used for regulating a thickness of a toner layer on the developing sleeve 1, is arranged on the toner flow path control member 5 so as to abut elastically against the developing sleeve 1. In this embodiment, the toner regulating material 7 is made of rubber elastic member such as urethane rubber or silicone rubber having a JIS A hardness of 50° to 70° and abuts against the developing sleeve 1 at a 5 to 50 g/cm linear load to regulate the toner layer.

The toner collecting roller 8, which is used for collecting development-residual toner which has not contributed to the development on the developer sleeve 1 into the developing container 3 and for returning the residual toner to a developing process again by electrically peeling the toner off the developing sleeve 1 and bearing it, is arranged spaced about 100 $\mu$m to 1 mm apart from the developing sleeve 1 so as to rotate in the reverse direction to the rotary direction of the developing sleeve 1 (in the same direction at the nearest portion to the developing sleeve 1).

While a metal cylinder having a mirror surface is used as the toner collecting roller 8 and it is electrically grounded in this embodiment, a Teflon or other fluorine resin layer having a thickness of about 2 $\mu$m to 50 $\mu$m can be arranged on the surface of the toner collecting roller 8, taking into consideration a releasing property from toner scraped off the developing sleeve 1. Adding this resin layer is preferable since it has an action of preventing an electrical leakage to the developing sleeve 1. A predetermined voltage can be applied to the toner collecting roller 8 depending upon the releasing property of toner.

The scraper 9 is used for scraping the development-residual toner which has been peeled off the developing sleeve 1 and borne by the toner collecting roller 8, off the surface of the toner collecting roller 8, and it abuts against an area at the bottom of the collecting roller 8 so that the scraped toner drops on the agitating member 10.

The agitating member 10 is used for supplying non-magnetic toner in the developer container 3 to the toner-supplying brush 4 while agitating the toner.

The nonmagnetic toner used in this embodiment is produced by mixing and dispersing colorant with a thermoplastic resin and grinding the mixture to particles each having a weight-average particle diameter of 5 $\mu$m or greater, and a polystyrene or polyester resin having the negative charging polarity is used as the thermoplastic resin. Furthermore, negative polarity charging control material is contained in this nonmagnetic toner.

As a developing method is used an image exposure-reversal developing method, in which the surface of the. photosensitive drum 11 is charged to the negative polarity using a charging means which is not shown, an electrostatic latent image is formed by an image exposure using an exposure means which is not shown, and a voltage made of superposed DC voltage having the negative polarity and AC voltages is applied to the developing sleeve 1 as a developing bias from a power supply 2 to apply the nonnegative toner having the negative polarity to the latent image (the exposed portion), in other words to develop the image reversely.

An OPC photosensitive member is used as the photosensitive drum 11. As the developing sleeve 1, is used a coated sleeve coated on its surface with a mixed resin of PMMA and demethylaminoethyl methacrylate in the ratio of 9:1.

Figure 4:
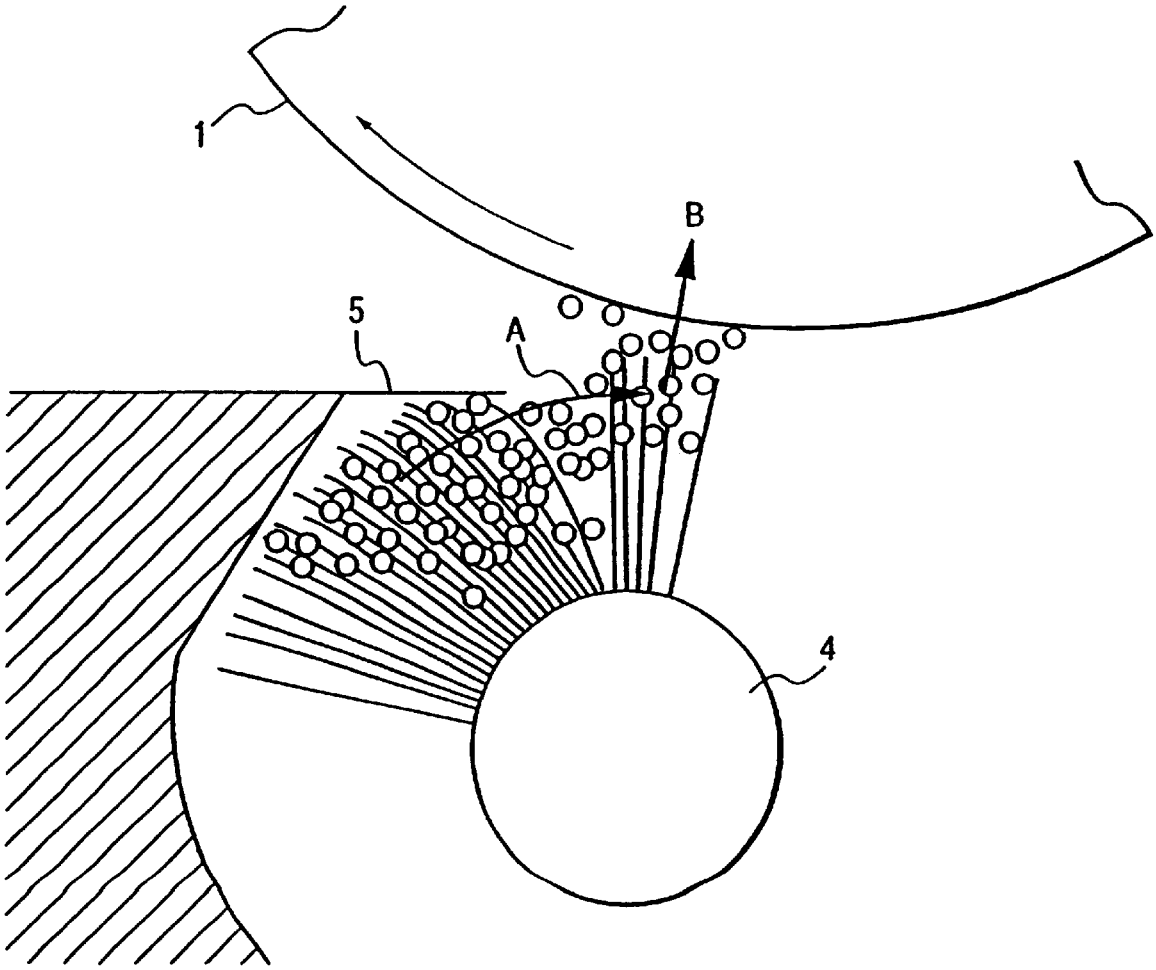
FIG. 4 is an explanatory diagram showing a toner supplying method in the developing apparatus in FIG. 1.

The non-magnetic toner contained in the developer container 3 is carried to the toner-supplying brush 4 while being agitated by the agitating member 10 and is charged to the negative polarity by being put in contact with filaments of the toner-supplying brush 4. Then, the toner is put between filaments or adheres to a surface of the filaments of the toner-supplying brush 4 by a reflecting force (mirroring force) or the like so as to be borne by the toner-supplying brush 4, and further it is carried in a direction of the toner flow path control member 5 with a rotation of the toner-supplying brush 4. The toner carried up to a contact portion with the toner flow path control member 5 is stably charged by being put into contact with the toner control path control member 5, and further, as shown in FIG. 4, passing the toner control path control member 5, is popped out as indicated by an arrow A in a rotary direction of the toner-supplying brush 4 by an elastic force of the filaments, and a cloudlike toner rises in the air between the toner-supplying brush 4 and the developing sleeve 1.

With popping out the toner between filaments of the toner-supplying brush 4 by putting the toner supplying brush 4 into contact with the toner flow path control member 5 as described above, it also becomes possible to prevent uncharged toner from remaining between filaments of the toner-supplying brush 4 with the uncharged toner popped out, and therefore there is an advantage of preventing a clogging of filaments of the brush caused by uncharged toner.

For the cloud-like toner which has risen in the above, there is formed an electric field vector B for attracting toner charged to the negative polarity by a developing bias applied to the developing sleeve 1 from the power supply 2 and a bias applied to the toner-supplying brush 4 from the power supply 6 in a direction of the developing sleeve 1, between the toner supplying brush 4 and the developing sleeve 1. Accordingly, only toner particles fully charged to the negative polarity among the rising toner particles are electrically attracted to the developing sleeve 1 by the electric field so as to be borne by the developing sleeve.

Figure 5:
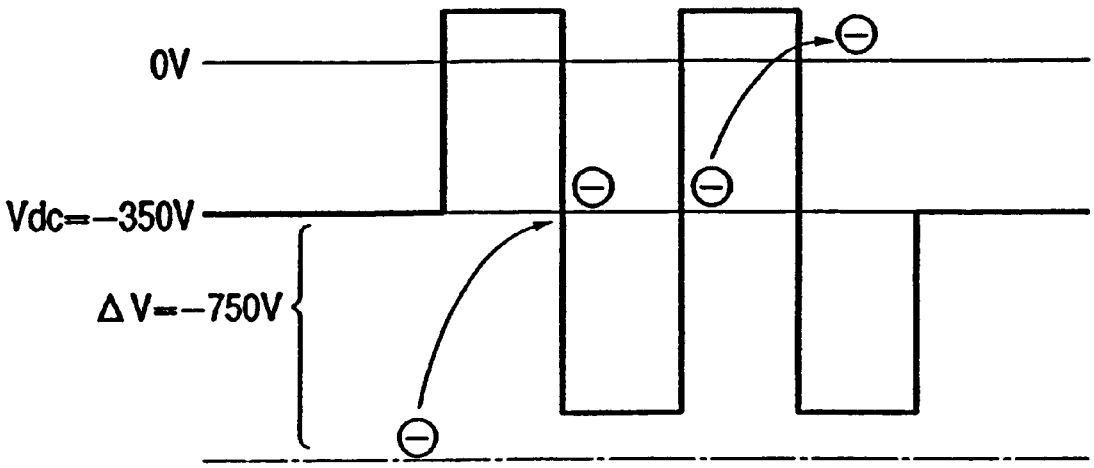
FIG. 5 is an explanatory diagram showing a bias at supplying toner in FIG. 4.
Figure 6:
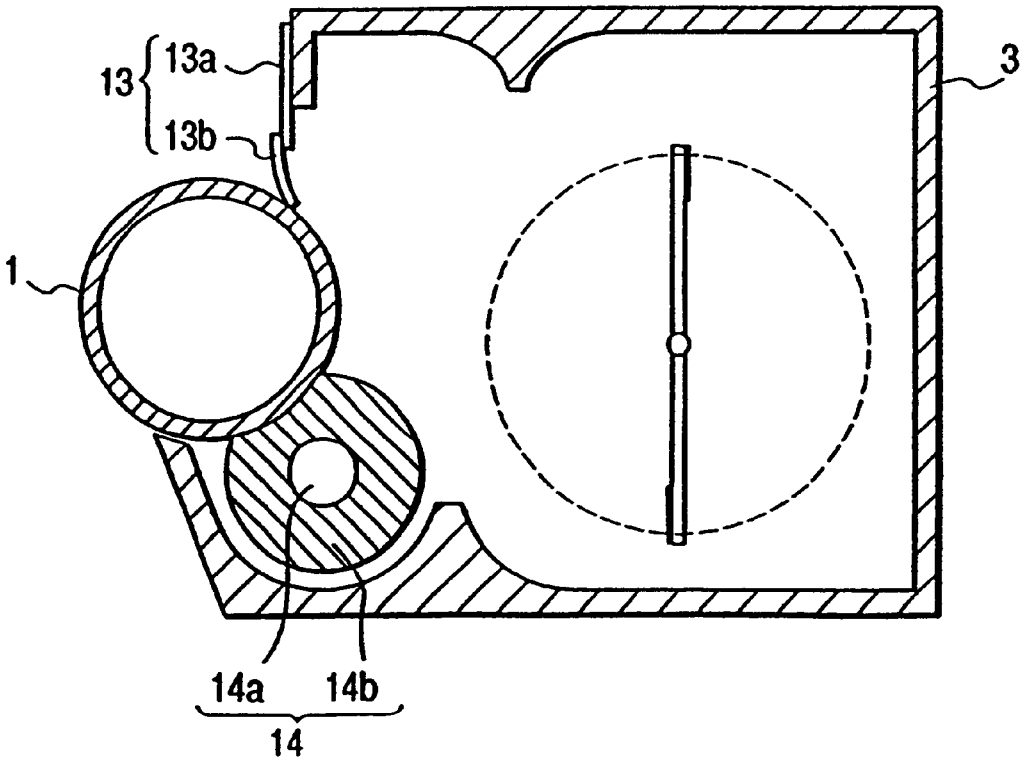
FIG. 6 PRIOR ART
FIG. 6 is a sectional view of a developing apparatus.

For example, as shown in FIG. 5, if a DC voltage of the developing bias is set to Vdc=−350 V, a setting is made to apply a bias generated by superposing a DC voltage of about $\Delta V=-750$ V from the power supply 6 on the developing bias to the toner supplying brush 4, by which the rising toner is attracted from the toner-supplying brush 4 to the developing sleeve 1 by an electric field action caused by a differential (−750 V) of the DC voltage since the toner is charged to the negative polarity.

The toner supplied to the developing sleeve 1 as described above is borne on its surface by a reflecting force and carried up to the toner regulating member 7 with a rotation of the developing sleeve 1, and then the toner is formed into a thin layer by the toner regulating member 7 made of an elastic member and triboelectricity are further supplied to the toner layer so as to form a thin and dense toner layer having a more uniformly charged amount distribution.

In this embodiment, a cloud-like charged toner is supplied onto the developing sleeve 1 without getting contact therewith by using an electric field as described above, and therefore a mechanical stress to the toner can be remarkably reduced. In addition, only fully-charged toner is supplied to the developing sleeve 1 for coating, and therefore it is possible to obtain a toner coat layer having an extremely sharp and less uneven amount distribution. Therefore, high-quality images can be stably obtained in the development.

The toner which has passed the toner regulating member 7 is dislocated for development according to an electrostatic latent image on the photosensitive drum 11 in the opposite portion to the photosensitive drum 11, the obtained toner image is conveyed to a transferring section which is not shown with a rotation of the photosensitive drum 11, and the toner image is transferred to a paper or other transfer material in the transferring section.

On the other hand, toner borne on the developing sleeve 1 and returned to the developer container 3 without contributing to the development is electrostatically peeled off the developing sleeve 1 by the electric field formed in the nearest portion between the toner-collecting roller 8 and the developing sleeve 1, and it is borne on the surface of the toner-collecting roller 8 so as to be collected. The born toner is scraped off the toner-collecting roller 8 by the scraper 9 arranged so as to be put into contact with the toner-collecting roller with a rotation of the toner-collecting roller 8 and returned to the developing process again.

By using the toner-collecting cylindrical roller 8 rotating as a developer collecting member in this manner, a fresh plane of electrodes is always opposite to a surface of the developing sleeve 1 and a stable electric field is constantly formed between the developing sleeve 1 and the toner-collecting roller 8, which increases an efficiency of collecting toner from the developing sleeve 1.

In addition, development-residual toner is reliably scraped off the toner-collecting roller 8 with every rotation of the developing sleeve 1, which suppresses a heat accumulation caused by a continuous rubbing friction with the photosensitive drum 11 which has conventionally occurred in a development process, by which a rapid toner degradation can be prevented.

[Second Embodiment]

The filaments of the toner supplying brush 4 are not limited to those described in the first embodiment. For example, when using toner charged to the positive polarity, it is desired to use materials having the negative charging polarity to the charging polarity of the toner as the insulating filaments 12*b* and the conductive filaments 12*a* of the toner-supplying brush 4.

In other words, when using toner made of a styrene-acrylic resin or a styrene-butadiene resin including a positive polarity charging control material as a thermoplastic resin, polyethylene or polypropylene filaments or the like are used for the insulating filaments 12*b* of the toner supplying brush 4 and the same filaments, polyethylene or polypropylene filaments, are also used for insulating filaments 12*b* as a base material member of the conductive filaments 12*a*.

Naturally insulating filaments as a base of the insulating filaments 12*b* may be different from those of the conductive filaments 12*a* as well as identical. For example, polyethylene filaments having a high charge supplying capability are used for the insulating filaments 12*b*, and polypropylene filaments in which carbon is dispersed are used for the conductive filaments 12*a*.

In this embodiment, by applying this filament constitution to the toner supplying brush 4, charges can be stably supplied to toner by using the toner supplying brush 4 even in using toner having the positive charging polarity, which results in a favorable toner supply to the developing sleeve 1.

As set forth hereinabove, according to this embodiment, there is arranged a toner-supplying brush composed of a brush roller on which filaments are planted as a developer supplying member on its surface opposite to a developer sleeve in a developing container of a nonmagnetic monocomponent developing apparatus, nonmagnetic toner of monocomponent developer is put among the filaments of the toner-supplying brush so as to be carried to the developing sleeve, and the toner is mechanically popped out of the brush filaments by an elastic force generated when the brush filaments are put into contact with the toner flow path control member so as to form a cloud-like toner, so that the cloud-like toner rises in the air between the toner supplying brush and the developing sleeve. At this point, the filaments of the toner supplying brush are formed of at least two types of filaments including conductive and insulating filaments, triboelectricity is supplied to the nonmagnetic toner by the insulating filaments, and an electric field is formed between the developing sleeve and the toner-supplying brush by the conductive filaments using a voltage applied to a portion between the developing sleeve and the toner-supplying brush 4 so as to achieve a noncontacting toner supply to the developing sleeve by utilizing toner rising in the air. Therefore, it becomes possible to coat the developing sleeve with toner which does not include a reversal toner nor uncharged toner, to obtain high-quality images having no fogging or the like stably for a long period, and to reduce loads on toner significantly so that a life of the toner can be remarkably extended. Furthermore, nonmagnetic monocomponent developing apparatus can be used as a toner-replenishing type for a long period.

What is claimed is:

1. A developing apparatus, comprising:

a developer bearing member for bearing developer to carry the developer to a developing portion;

a rotary brush, provided so as not to be in contact with said developer bearing member, for supplying triboelectricity to the developer; and electric field forming means for forming an electric field between said developer bearing member and said rotary brush for directing the developer having the triboelectricity from said rotary brush to said developer bearing member;

wherein said rotary brush includes low resistance filaments and high resistance filaments having a triboelectric charging ability higher than that of the low resistance filaments.

2. A developing apparatus according to claim 1, wherein said developer is non magnetic monocomponent developer.

3. A developing apparatus according to claim 1, wherein a cloud of the developer is formed between said rotary brush and said developer bearing member.

4. A developing apparatus according to claim 1, wherein a volume resistance value of said low resistance filaments is $10^2$ to $10^8$ Ω·cm, and a volume resistance value of said high resistance filaments is $10^8$ to $10^{15}$ Ω·cm.

5. A developing apparatus according to claim 4, wherein said high resistance filaments are nylon filaments.

6. A developing apparatus according to claim 4, wherein said high resistance filaments each have an insulating portion in which a conductive portion is dispersed.

7. A developing apparatus according to claim 1, further comprising a peeling member for peeling the developer borne on said developer bearing member, wherein said peeling member is not in contact with said developer bearing member.

8. A developing apparatus according to claim 7, wherein said peeling member rotates in a reverse direction to a rotary direction of said developer bearing member.

9. A developing apparatus according to claim 7, wherein said peeling member comprises a metal cylinder having a mirror surface.

10. A developing apparatus according to claim 7, wherein said peeling member electrically peels the developer borne on said developer bearing member.

11. A developing apparatus according to claim 7, wherein a voltage is applied to said peeling member.

12. A developing apparatus according to claim 11, wherein said the voltage is generated by superposing an AC voltage on a DC voltage.

* * * * *

UNITED STATES PATENT AND TRADEMARK OFFICE

CERTIFICATE OF CORRECTION

PATENT NO. : 6,278,856 B1
DATED : August 21, 2001
INVENTOR(S) : Takeshi Yamamoto It is certified that error appears in the above-identified patent and that said Letters Patent is hereby corrected as shown below:

Title page,
Item [56], References Cited, under U.S. PATENT DOCUMENTS,

| | | |
|---|---|---|
| "5,172,189 | 12/1992 | Takashia et al." should read |
| -- 5,172,169 | 12/1992 | Takashia et al. -- |

Column 1,
Line 54, "photosensitive drum" should read -- photosensitive drum 1 --.

Column 2,
Line 2, "drum," should read -- drum 1 --;
Line 4, "supply" should read -- supplied --; and
Line 50, "a" should be deleted.

Column 3,
Line 53, "photosensititve." should read -- photosensitive --.

Column 5,
Line 18, "developer sleeve 1" should read -- developing sleeve 1 -- and "developing" should read -- developer --; and
Line 41, "collecting roller 8" should read -- toner collecting roller 8 --.

Column 6,
Line 2, "demethylaminoethyl" should read -- dimethylaminoethyl --;
Line 15, "control" (first occurrence) should read -- flow --; and
Line 17, "control" (first occurrence) should read -- flow --.

Column 7,
Line 15, "born" should read -- borne --; and
Line 20, "cylindrical" should be deleted.

UNITED STATES PATENT AND TRADEMARK OFFICE

CERTIFICATE OF CORRECTION

PATENT NO. : 6,278,856 B1
DATED : August 21, 2001
INVENTOR(S) : Takeshi Yamamoto It is certified that error appears in the above-identified patent and that said Letters Patent is hereby corrected as shown below:

Column 8,
Line 44, "non magnetic" should read -- nonmagnetic --.

Column 10,
Line 2, "said" should be deleted.

Signed and Sealed this

Seventh Day of May, 2002

*Attest:*

*Attesting Officer*

JAMES E. ROGAN
*Director of the United States Patent and Trademark Office*